US011624539B2

(12) United States Patent
Cluff

(10) Patent No.: US 11,624,539 B2
(45) Date of Patent: Apr. 11, 2023

(54) MAINTAINING SUPERHEAT CONDITIONS IN A COMPRESSOR

(71) Applicant: CARRIER CORPORATION, Palm Beach Gardens, FL (US)

(72) Inventor: Charles A. Cluff, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 332 days.

(21) Appl. No.: 16/745,736

(22) Filed: Jan. 17, 2020

(65) Prior Publication Data

US 2020/0248944 A1 Aug. 6, 2020

Related U.S. Application Data

(60) Provisional application No. 62/801,774, filed on Feb. 6, 2019.

(51) Int. Cl.
*F25B 49/02* (2006.01)
*F25B 40/06* (2006.01)

(52) U.S. Cl.
CPC ..... *F25B 49/022* (2013.01); *F25B 40/06* (2013.01); *F25B 2400/01* (2013.01)

(58) Field of Classification Search
CPC .... F25B 49/022; F25B 40/06; F25B 2400/01; F25B 49/005; F25B 2500/06; F25B 2500/27; F25B 2600/15; F25B 2700/193; F25B 2700/2115
See application file for complete search history.

(56) References Cited

U.S. PATENT DOCUMENTS

| | | | | |
|---|---|---|---|---|
| 2,107,887 | A | 2/1938 | Davenport | |
| 3,133,429 | A | 5/1964 | Griffin | |
| 3,705,499 | A | 12/1972 | Mount et al. | |
| 4,066,869 | A | 1/1978 | Apoloo et al. | |
| 4,236,379 | A | 12/1980 | Mueller | |
| 4,888,957 | A | 12/1989 | Chmielewski | |
| 5,062,277 | A | 11/1991 | Heitmann et al. | |
| 5,230,222 | A | 7/1993 | Erbs | |
| 5,369,958 | A * | 12/1994 | Kasai | F24F 3/065 62/158 |
| 6,490,882 | B2 | 12/2002 | Tipton | |
| 6,834,513 | B2 | 12/2004 | O'Brien et al. | |

(Continued)

FOREIGN PATENT DOCUMENTS

| | | | |
|---|---|---|---|
| CN | 105466095 | A | 4/2016 |
| CN | 106440589 | A | 2/2017 |

(Continued)

OTHER PUBLICATIONS

"Superhead, n." OED Online. Dec. 2021. Oxford University Press. https://www.oed.com/view/Entry/314183?rskey=SrP0sk&result=1&isAdvanced=false (accessed Dec. 19, 2021). (Year: 2021).

*Primary Examiner* — Kun Kai Ma
(74) *Attorney, Agent, or Firm* — Carlson, Gaskey & Olds, P.C.

(57) ABSTRACT

An illustrative example refrigerant system includes a compressor configured to pressurize a refrigerant fluid. The compressor includes a sump portion. A heater is situated to heat at least the sump portion. A controller is configured to selectively operate the heater to apply heat to at least the sump portion while the compressor is off to establish and maintain a superheat condition in the compressor.

20 Claims, 1 Drawing Sheet

(56) References Cited

U.S. PATENT DOCUMENTS

| | | | |
|---|---|---|---|
| 6,886,354 | B2 | 5/2005 | Dudley |
| 6,925,823 | B2 | 8/2005 | Lifson et al. |
| 8,720,212 | B2 | 5/2014 | Wakuta et al. |
| 8,734,125 | B2 | 5/2014 | McSweeney et al. |
| 9,181,939 | B2 | 11/2015 | Pham |
| 9,353,738 | B2 | 5/2016 | Ramayya |
| 9,551,357 | B2 | 1/2017 | Waller |
| 9,851,135 | B2 | 12/2017 | Pham |
| 9,879,894 | B2 | 1/2018 | Ramayya |
| 9,897,360 | B2 | 2/2018 | Yura |
| 9,903,627 | B2 | 2/2018 | Fraser et al. |
| 9,915,258 | B2 | 3/2018 | Perez et al. |
| 9,939,184 | B2 | 4/2018 | Yura et al. |
| 10,024,591 | B2 | 7/2018 | Goel et al. |
| 10,047,965 | B2 | 8/2018 | Mackey et al. |
| 10,119,734 | B2 | 11/2018 | Guldali et al. |
| 2010/0125368 | A1 | 5/2010 | Bailey et al. |
| 2014/0000295 | A1 | 1/2014 | Schuster |
| 2014/0138451 | A1 | 5/2014 | Pham |
| 2015/0185197 | A1 | 7/2015 | Liang et al. |
| 2015/0276276 | A1 | 10/2015 | Goel et al. |
| 2015/0330651 | A1 | 11/2015 | Goel |
| 2015/0330688 | A1 | 11/2015 | Goel et al. |
| 2016/0265798 | A1 | 9/2016 | Havard, Jr. et al. |
| 2016/0327323 | A1* | 11/2016 | Goel ..... F25B 39/028 |
| 2017/0299240 | A1 | 10/2017 | Mercer |
| 2018/0080694 | A1 | 3/2018 | Kihara et al. |
| 2020/0248944 | A1 | 8/2020 | Cluff |

FOREIGN PATENT DOCUMENTS

| | | | |
|---|---|---|---|
| CN | 107255069 | A | 10/2017 |
| EP | 2051024 | B1 | 6/2017 |
| WO | 2009/096620 | A1 | 8/2009 |

* cited by examiner

MAINTAINING SUPERHEAT CONDITIONS IN A COMPRESSOR

CROSS REFERENCE TO RELATED APPLICATION

This application claims priority to U.S. Provisional Application No. 62/801,774, filed on Feb. 6, 2019.

BACKGROUND

Air conditioning and refrigeration systems are well known. A typical refrigerant circuit includes a compressor, a condenser, an expansion valve and an evaporator. While such circuits have proven useful and reliable, there are certain conditions that may occur that can adversely affect the system.

For example, under some conditions, such as when the system is idle or shut down, liquid refrigerant tends to migrate to the coldest parts of the system. The compressor is often the coldest component because it is typically within the outdoor equipment. If liquid refrigerant is left in the compressor it is possible for the liquid refrigerant to mix with oil in the compressor. One problem associated with such a mixture is that it may develop into a foam when the compressor begins to operate, and oil may be introduced into other portions of the circuit, depleting the oil in the compressor and increasing the risk of damage or premature wear of compression elements. Another problem that may arise is that the refrigerant may dilute the lubricating capacity of the oil, which is needed for proper compressor operation over time.

SUMMARY

An illustrative example embodiment of a refrigerant system includes a compressor configured to pressurize a refrigerant fluid. The compressor includes a sump portion. A heater is situated to heat at least the sump portion. A controller is configured to selectively operate the heater to apply heat to at least the sump portion while the compressor is off to maintain a superheat condition in the compressor.

In an embodiment having one or more features of the system of the previous paragraph, the controller is configured to determine whether the superheat condition exists in the compressor based on a temperature and a pressure associated with the compressor.

In an embodiment having one or more features of the system of any of the previous paragraphs, the compressor includes a shell and the pressure is inside the shell.

In an embodiment having one or more features of the system of any of the previous paragraphs, the temperature is at least one of inside or on the shell.

In an embodiment having one or more features of the system of any of the previous paragraphs, the controller is configured to determine a minimum temperature to maintain the superheat condition based on the pressure.

In an embodiment having one or more features of the system of any of the previous paragraphs, the controller is configured to determine at least one of the temperature and the pressure based on a temperature or pressure of another component of the refrigerant system in fluid communication with the compressor.

In an embodiment having one or more features of the system of any of the previous paragraphs, the controller is configured to operate the heater to apply a first amount of heat when a current temperature of the compressor is below a minimum temperature needed for the superheat condition, the controller is configured to operate the heater to apply a second amount of heat when the superheat condition exists, and the first amount of heat is greater than the second amount of heat.

An illustrative example method of controlling a temperature of a compressor of a refrigerant system includes operating a heater for heating at least a sump portion of the compressor while the compressor is off to maintain a superheat condition in the compressor.

An embodiment having one or more features of the method of the previous paragraph includes determining whether the superheat condition exists in the compressor based on a temperature and a pressure associated with the compressor.

In an embodiment having one or more features of the method of any of the previous paragraphs, the compressor includes a shell and the pressure is inside the shell.

In an embodiment having one or more features of the method of any of the previous paragraphs, the temperature is at least one of inside or on the shell.

An embodiment having one or more features of the method of any of the previous paragraphs includes determining a minimum temperature to maintain the superheat condition based on the pressure.

An embodiment having one or more features of the method of any of the previous paragraphs includes determining at least one of the temperature and the pressure based on a temperature or pressure of another component of the refrigerant system in fluid communication with the compressor An embodiment having one or more features of the method of any of the previous paragraphs includes operating the heater to apply a first amount of heat when a current temperature of the compressor is below a minimum temperature needed for the superheat condition and operating the heater to apply a second amount of heat when the superheat condition exists. The first amount of heat is greater than the second amount of heat.

An illustrative example refrigerant system controller includes a processor and memory including instructions that are executable by the processor to operate a heater for heating at least a sump portion of a compressor while the compressor is off to maintain a superheat condition in the compressor.

In an embodiment having one or more features of the controller of the previous paragraph, the instructions include instructions that are executable by the processor to determine whether the superheat condition exists in the compressor based on a temperature and a pressure associated with the compressor.

In an embodiment having one or more features of the controller of any of the previous paragraphs, the instructions include instructions that are executable by the processor to determine a minimum temperature to maintain the superheat condition based on the pressure.

In an embodiment having one or more features of the controller of any of the previous paragraphs, the instructions include instructions that are executable by the processor to determine at least one of the temperature and the pressure based on a temperature or pressure of another component of the refrigerant system in fluid communication with the compressor.

In an embodiment having one or more features of the controller of any of the previous paragraphs, the compressor includes a shell, the pressure is inside the shell, and the temperature is at least one of inside or on the shell.

In an embodiment having one or more features of the controller of any of the previous paragraphs, the instructions include instructions that are executable by the processor to operate the heater to apply a first amount of heat when a current temperature of the compressor is below a minimum temperature needed for the superheat condition, and operate the heater to apply a second amount of heat when the superheat condition exists. The first amount of heat is greater than the second amount of heat.

The various features and advantages of at least one disclosed example embodiment will become apparent to those skilled in the art from the following detailed description. The drawings that accompany the detailed description can be briefly described as follows.

DETAILED DESCRIPTION

Figure 1:
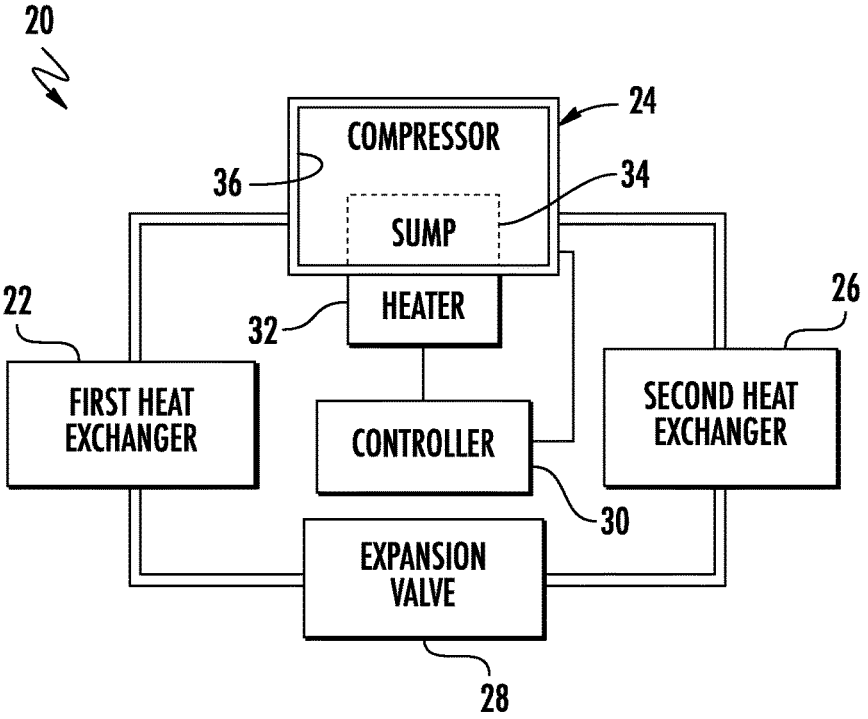
FIG. 1 schematically illustrates selected portions of a refrigerant system according to an embodiment of the present disclosure.

FIG. 1 schematically illustrates a system 20 that includes a refrigerant circuit capable of operating as a heat pump or providing air conditioning or refrigeration, for example. The refrigerant circuit includes a first heat exchanger 22, a compressor 24, a second heat exchanger 26 and an expansion valve 28 that operate in a known manner. In some implementations, the first heat exchanger 22 is configured to be situated within a temperature conditioned space, such as a building or a residence, and the second heat exchanger 26 is configured to be situated outside the space. The direction of refrigerant fluid flow through the circuit will be consistent with the intended operation as a heat pump or air conditioner.

A controller 30, which includes a processor or another computing device and memory, is configured to control operation of the compressor. In some situations, the compressor 24 remains idle or inoperative. Under certain circumstances, such as when cooling is needed, the controller 30 turns on the compressor 24 and causes it to operate such that the compressor 24 pressurizes refrigerant fluid within the circuit in a known manner.

A heater 32 is associated with the compressor 24. In the illustrated example system, the compressor 24 includes a sump portion 34 and a shell 36. The heater 32 is situated to heat at least the sump portion 34 of the compressor 24. The controller 30 is configured to selectively operate the heater 32. While the compressor 24 is off, the controller 30 causes the heater 32 to operate to maintain a superheat condition in the compressor 24.

Figure 2:
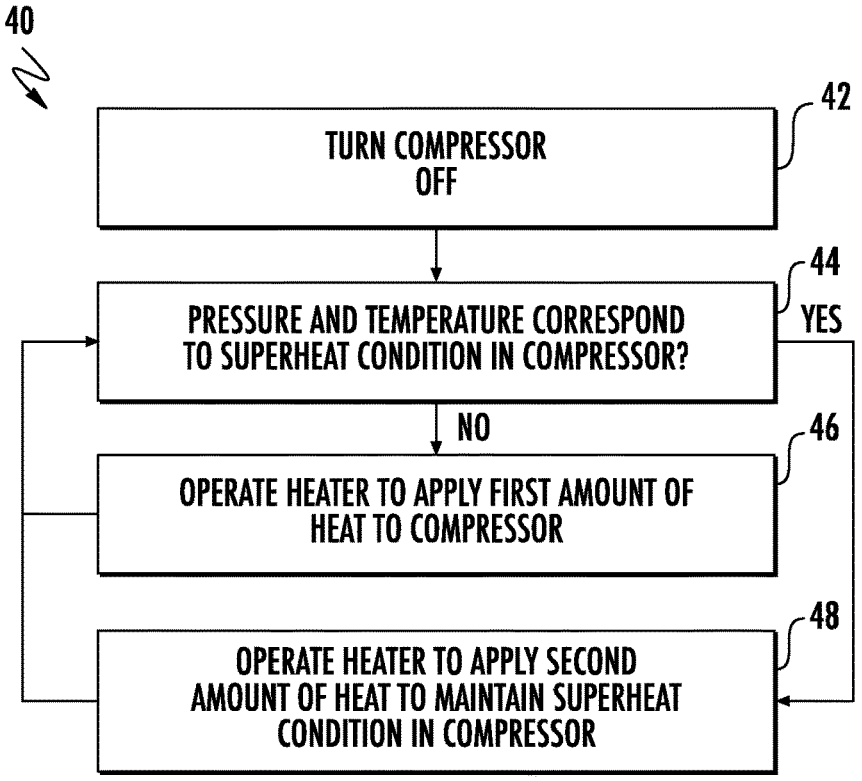
FIG. 2 is a flow chart diagram summarizing an example control method according to an embodiment of the present disclosure.

FIG. 2 is a flowchart diagram 40 that summarizes an example control strategy. At 42, the compressor 24 turns off, which may be based on a command from the controller 30.

The controller 30 determines a temperature and a pressure associated with the compressor 24 and, at 44, determines if the temperature and pressure correspond to a superheat condition in the compressor 24. Although not illustrated, known temperature and pressure sensors may be included in various locations within the system 20 to provide such information to the controller 30. In the illustrated example embodiment, the controller 30 determines a pressure within the shell 36 of the compressor 24 and a temperature on or in the shell 36. In some embodiments, the controller 30 determines a pressure near the compressor 24 and a corresponding temperature.

The controller 30 uses the temperature and pressure information to determine whether a superheat condition exists in the compressor 24. A superheat condition is that which includes a temperature and pressure that is above the saturation point of the refrigerant. The superheat condition ensures that any refrigerant in the compressor 24 is in a vapor state and no liquid refrigerant is allowed to accumulate in the compressor 24. There are known pressure and temperature relationships that correspond to superheat conditions and the controller 30 uses at least one such relationship to determine whether the determined temperature satisfies a minimum temperature requirement to maintain superheat conditions given the determined pressure.

At 46, the controller 30 causes the heater 32 to operate to apply a first amount of heat when the temperature and pressure do not correspond to a superheat condition. The first amount of heat is intended to raise the temperature of at least the sump portion 34 of the compressor 24 to establish superheat conditions in the compressor 24. The first amount of heat may be sufficient, for example, to vaporize any liquid refrigerant in the compressor 24.

The controller 30 continues to monitor the pressure and temperature at 44 until a superheat condition exists in the compressor 24. When that condition exists, the controller 30 operates the heater at 48 to apply a second, lower amount of heat to maintain the superheat condition in the compressor 24.

In the illustrated example embodiment, the controller 30 continues the operation of the heater 32 as long as the compressor is off. The controller 30 in some embodiments dynamically adjusts the heat supplied by the heater 32 to maintain the superheat condition in the compressor 24 while using as little energy as possible.

One aspect of the illustrated example embodiment is that it minimizes or eliminates the possibility of liquid refrigerant collecting in the compressor 24 while the compressor is off. Maintaining a superheat condition in the compressor 24 also minimizes or eliminates the possibility of refrigerant condensation as the compressor 24 starts up at the beginning of a subsequent operating cycle. Keeping liquid refrigerant out of the compressor 24 enhances system efficiency and extends the useful life of the compressor components and the oil used to lubricate those components. The example embodiment is also more energy efficient than systems that apply heat for other reasons or based on other conditions because only as much heat as is needed to maintain a superheat condition in the compressor 24 will be applied.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A refrigerant system, comprising:

a compressor configured to pressurize a refrigerant fluid, the compressor including a sump portion;

a heater situated to heat at least the sump portion; and a controller that is configured to selectively operate the heater to apply heat to at least the sump portion while the compressor is off to maintain a superheat condition in the compressor and determine whether the superheat condition exists in the compressor based on a temperature and a pressure associated with the compressor, wherein the compressor includes a shell and the pressure is inside the shell.

2. The refrigerant system of claim 1, wherein the temperature is at least one of inside or on the shell.

3. The refrigerant system of claim 1, wherein the controller is configured to determine a minimum temperature to maintain the superheat condition based on the pressure.

4. The refrigerant system of claim 1, wherein the controller is configured to determine at least one of the temperature and the pressure based on a temperature or pressure of another component of the refrigerant system in fluid communication with the compressor.

5. The refrigerant system of claim 1, wherein the controller is configured to operate the heater to apply a first amount of heat when a current temperature of the compressor is below a minimum temperature needed for the superheat condition;

the controller is configured to operate the heater to apply a second amount of heat when the superheat condition exists; and the first amount of heat is greater than the second amount of heat.

6. A method of controlling a temperature of a compressor in a refrigerant system, the method comprising:

operating a heater for heating at least a sump portion of the compressor while the compressor is off to maintain a superheat condition in the compressor, determining whether the superheat condition exists in the compressor based on a temperature and a pressure associated with the compressor, and determining a minimum temperature to maintain the superheat condition based on the pressure.

7. The method of claim 6, wherein the compressor includes a shell; and the pressure is inside the shell.

8. The method of claim 7, wherein the temperature is at least one of inside or on the shell.

9. The method of claim 6, comprising determining at least one of the temperature and the pressure based on a temperature or pressure of another component of the refrigerant system in fluid communication with the compressor.

10. The method of claim 6, comprising operating the heater to apply a first amount of heat when a current temperature of the compressor is below a minimum temperature needed for the superheat condition; and operating the heater to apply a second amount of heat when the superheat condition exists;

wherein the first amount of heat is greater than the second amount of heat.

11. A refrigerant system controller comprising a processor and memory including instructions that are executable by the processor to operate a heater for heating at least a sump portion of a compressor while the compressor is off to maintain a superheat condition in the compressor, the instructions including instructions that are executable by the processor to operate the heater to apply a first amount of heat when a current temperature of the compressor is below a minimum temperature needed for the superheat condition and operate the heater to apply a second amount of heat when the superheat condition exists, wherein the first amount of heat is greater than the second amount of heat.

12. The refrigerant system controller of claim 11, wherein the instructions include instructions that are executable by the processor to determine whether the superheat condition exists in the compressor based on a temperature and a pressure associated with the compressor.

13. The refrigerant system controller of claim 12, wherein the instructions include instructions that are executable by the processor to determine a minimum temperature to maintain the superheat condition based on the pressure.

14. The refrigerant system controller of claim 12, wherein the instructions include instructions that are executable by the processor to determine at least one of the temperature and the pressure based on a temperature or pressure of another component of the refrigerant system in fluid communication with the compressor.

15. The refrigerant system controller of claim 12, wherein the compressor includes a shell;

the pressure is inside the shell; and the temperature is at least one of inside or on the shell.

16. A refrigerant system, comprising:

a compressor configured to pressurize a refrigerant fluid, the compressor including a sump portion;

a heater situated to heat at least the sump portion; and a controller that is configured to:

selectively operate the heater to apply heat to at least the sump portion while the compressor is off to maintain a superheat condition in the compressor, operating the heater to apply a first amount of heat when a current temperature of the compressor is below a minimum temperature needed for the superheat condition, and operating the heater to apply a second amount of heat when the superheat condition exists, wherein the first amount of heat is greater than the second amount of heat.

17. The refrigerant system of claim 16, wherein the controller is configured to determine a minimum temperature to maintain the superheat condition based on the pressure.

18. The refrigerant system of claim 16, wherein the controller is configured to determine whether the superheat condition exists in the compressor based on a temperature and a pressure associated with the compressor.

19. The refrigerant system of claim 18, wherein the compressor includes a shell, the pressure is inside the shell, and the temperature is at least one of inside or on the shell.

20. The refrigerant system of claim 16, wherein the controller is configured to determine a minimum temperature to maintain the superheat condition based on the pressure.

* * * * *